United States Patent [19]

Paciga et al.

[11] 3,986,791

[45] Oct. 19, 1976

[54] HYDRODYNAMIC MULTI-STAGE PUMP

[75] Inventors: Alexander Paciga; Oldrich Strycek; Martin Ganco, all of Bratislava; Michal Varchola, Trencin, all of Czechoslovakia

[73] Assignee: Sigma Lutin, narodni podnik, Lutin, Czechoslovakia

[22] Filed: Sept. 18, 1974

[21] Appl. No.: 507,294

[30] Foreign Application Priority Data

Apr. 1, 1974 Czechoslovakia ..... 2308-74

[52] U.S. Cl. ..... 415/199 A; 415/219 C

[51] Int. Cl.[2] ..... F04D 29/44

[58] Field of Search ..... 415/199 A, 501, 219 C, 415/198

[56] References Cited

UNITED STATES PATENTS

| | | | |
|---|---|---|---|
| 1,135,364 | 4/1915 | Doble | 415/199 A |
| 1,837,873 | 12/1931 | MacMeeken | 415/199 A |
| 1,857,486 | 5/1932 | Trumpler | 415/199 A |
| 2,474,077 | 6/1949 | Trumpler | 415/219 C |
| 2,854,926 | 10/1958 | Haight et al. | 415/501 |
| 3,017,837 | 1/1962 | Judd | 415/501 |
| 3,289,923 | 12/1966 | Millman | 415/199 A |
| 3,361,073 | 1/1968 | Medgyesy | 415/219 C |
| 3,438,329 | 4/1969 | Fuller | 415/501 |
| 3,776,664 | 12/1973 | Kimmel | 415/501 |
| 3,799,691 | 3/1974 | Senlis | 415/199 A |

FOREIGN PATENTS OR APPLICATIONS

| | | | |
|---|---|---|---|
| 1,260,312 | 7/1962 | Germany | 415/199 A |

*Primary Examiner*—Henry F. Raduazo

[57] ABSTRACT

A hydrodynamic pump comprising a casing in which a shaft having a plurality of spaced impellers is mounted. The casing is formed with diffuser channels interposed between successive impellers. Each diffuser channel comprises a curved section communicating with the outlet of one impeller and an axially-radial centripetal guide channel having a plurality of vanes located therein. Each of the vanes has a curved pressure face and a curved suction face. The angles of inclination of the curvature of the pressure and suction faces at the inlet end of the vanes are both within the range of 5° to 30°. The angle of inclination of curvature of the outlet with respect to the suction face of the vane is within one 100° to 130° and the angle of inclination of the curvature of the outlet with respect to the discharge pressure face is between 60° to 90°.

3 Claims, 3 Drawing Figures

HYDRODYNAMIC MULTI-STAGE PUMP

RELATED APPLICATION

The present application is related to a co-pending application of which one of the inventors is the inventor, Ser. No. 507,211, filed on even date hereof corresponding to Czechoslovak patent application No. PV8319/68 dated Dec. 6, 1968 now U.S. Pat. No. 3,964,841. The co-pending applicaton deals with the structure of the impeller and its blades and may be referred herein as if more fully set forth.

BACKGROUND OF THE INVENTION

The present invention relates to multi-stage hydrodynamic pumps and in particular to the construction of the diffuser guide vanes therefor.

Multi-stage hydrodynamic centrifugal pumps are formed with a succession of impellers, separated by interstage channels which cause the liquid from one impeller to be carried to the succeeding impeller. In the known construction of centrifugal pumps, the liquid after leaving the first impeller enters a radially centrifugal, or a radially-axial vane diffuser. After leaving the diffuser the liquid flows through an annular vaneless section, the inlet and outlet portions of which are, in the radial design both curved or bent, while in the radial axial design the inlet portion is straight and only the outlet portion is curved or bent. From this vaneless section, the liquid flows into a guide channel provided with directional vanes which deflect and change the flow of the liquid so that it leaves the channel at an angle approaching 90° with respect to the circumferential direction, so that it would enter the second impeller in a general axial direction. In some constructions, the centrifugal vane diffuser is connected directly with the vaned guide channel so as to form a single unit, omitting thereby the vaneless section. In any event the known constructions of multi-stage pumps, with the conventional diffusers, have the disadvantage in that they require the pump to have a relatively large outer diameter, so that they may be adequately dimensioned for the movement of the liquid. In addition, such pumps employing the conventional diffusers, suffer from undesirable vibration, pulsation, and substantial instability of performance characteristics.

It is the object of the present invention to provide a multi-stage hydrodynamic pump having an improved diffuser guide vane construction which overcomes the defects and disadvantages of the prior art.

It is a further object of the present invention to provide an improved construction and configuration for the guide vanes of a diffuser for a hydrodynamic multi-stage pump which provides greater operating efficiency, reduction of vibration as well as increased stability of performance characteristics.

The foregoing objects, other objects and advantages will be apparent from the following disclosure of the present invention.

SUMMARY OF THE INVENTION

According to the present invention a hydrodynamic pump is provided with a diffuser for directing the flow of liquid between successive impellers which comprises a curved section communicating with the outlet of one of the propellers and an axial radially centripetal guide channel having a plurality of guide vanes located within it. Each of the guide vanes has a curved pressure face and a curved suction face. The angles of inclination of the curvature of the pressure and suction faces at the inlet end of each vane is within a similar angular range while the outlet angle of inclination with respect to the suction face of the vane is greater than the outlet angle with respect to the discharge or pressure face of the vane.

Preferably, the angle of inclination of the curvature of the pressure and suction faces at the inlet end of the vane is within the range of 5° to 30°, the angle of inclination at the outlet end with respect to the suction face of the vane is within 100° to 130°, while the angle of inclination of the outlet end with respect to the discharge or pressure face is between 60° to 90°.

Full details of the present invention follow herein and are shown on the accompanying drawing.

DESCRIPTION OF THE INVENTION

Figure 1:
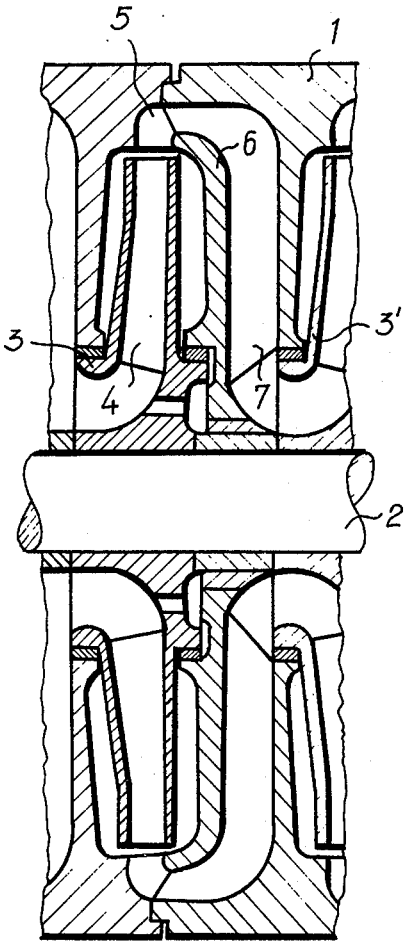
FIG. 1 is an axial section through a multi-stage pump showing the diffuser channel of the present invention interposed between two successive impellers.

In FIG. 1 a multi-stage hydrodynamic pump, such as a volute pump is shown embodying the present invention and comprises an outer casing 1 in which a shaft 2 is rotatably mounted along a central axis. Fixedly mounted or keyed onto the shaft 2 are a succession of impellers 3, 3' (only two of which are shown). Each impeller has a plurality of curved blades 4, defining an axial central inlet and a radially peripheral outlet.

The casing is formed so as to provide an annular surrounding vaneless channel section 5 about the periphery of the impeller. The vaneless channel 5 communicates in an elbow like section with the outlets of the impeller blades and with a centripetal guide channel 6 which is interposed between the successive impellers 3 and 3'. The guide channel 6 has an outlet axially directed in communication with the inlet of the succeeding impeller and a plurality of vanes 7 to guide the fluid from one impeller to the next. In general, the pump resembles a conventional hydrodynamic pump having multiple stages, and functions in generally the well known manner.

Figure 2:
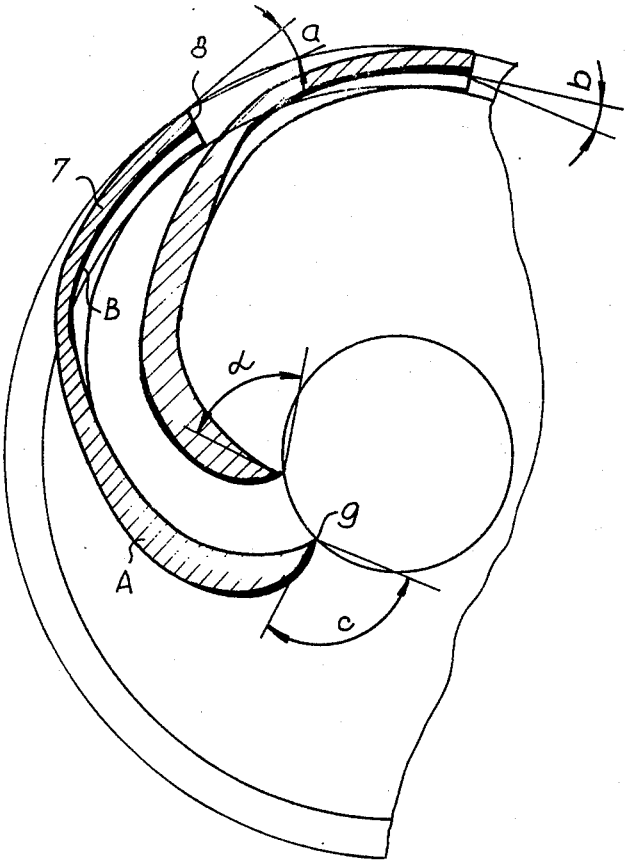
FIG. 2 is a radial section showing the diffuser guide vanes, of FIG. 1.

According to the present invention the guide vanes 7 are each formed with a shape changing their course from the axial inlet direction, smoothly and gradually into a radially-centripetal direction. As seen in FIG. 2, each vane has a curved suction face A and a curved discharge or pressure face B, a leading edge 8 and a trailing edge 9. At the leading edge an angle $a$ is formed with respect to a tangent to the suction face and an angle $b$ is formed with respect to a tangent to the pressure face. Similarly, at the trailing edge an angle $c$ is formed with a tangent to the suction face and an angle $\alpha$ is formed with a tangent to the pressure discharge face. In addition to the novel shape providing the smooth and gradual transition from axial to radially centripetal direction, the vanes are characterized by the angular dimensions of the inlet and outlet angles $a$, $b$, $c$, and $\alpha$ at both the trailing and leading edges.

According to the present invention the value of the inlet angles $a$ and $b$ may vary within a similar range of between 5° to 30°. The outlet angle c is within the range of 100° to 130°, while the outlet angle $\alpha$ is within the range of 60° to 90°. Thus the outlet angle $c$ on the suction face A is larger than the angle $\alpha$ on the discharge or pressure face B, of each of the guide vanes 7.

Figure 3:
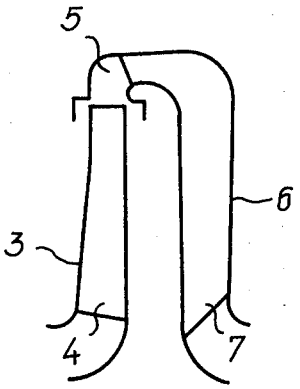
FIG. 3 is a diagramatic sketch of the portion of the multi-stage pump shown in FIG. 1.

As is seen in FIG. 3 the liquid leaving the outlet of the blade 4 of the impeller 3 passes through the vaneless annular curved section 5, and thence through the axial-radial centripetal channel 6 where it is diffused by the plurality of guide vanes 7, formed in accordance with the present invention. The guide vanes 7 deflect and change the flow of fluid from its axial direction, formed by the curved section 5 into the axially radial centripetal direction at the outlet end of the vane. The design of the guide vane channel 6 and the vaneless section 5 as one unitary construction, directly communicating and linked with the impeller 3, reduces the outer diameter of the pump and hence allows the overall mass of the pump to be held to a minimum. The axially-radial centripetal guide vanes 7 further reduces the need for an enlarged diameter by effectively deflecting and changing the course of the liquid smoothly with small pressure pulsations, or vibration. In general, the characteristic curve QY by which the hydrodynamic pump is conventionally measured shows an increased stability and efficiency.

Various changes and modifications can be made to the present invention and the present invention may be employed in a variety of hydrodynamic pumps. It is accordingly intended that the present disclosure be taken as illustrative only and not limiting of the present invention.

What is claimed is:

1. A hydrodynamic pump comprising a casing a shaft rotatably mounted in said casing, a plurality of spaced impellers is mounted on said shaft and extending outwardly from the axis thereof and having a central inlet and a radial peripheral outlet and a liquid diffuser channel interposed between successive impellers, each of said channels comprising a vaneless radial intake section communicating with the outlet of the preceeding impeller a curved elbow section generally extending parallel to the axis of said shaft and a straight section generally extending radially to the axis of said shaft, a plurality of guide vanes located within said elbow and straight sections, each of said guide vanes having curved pressure and suction surfaces, the curvature of which is shaped to provide a smooth and gradual change from axial to radially directed centripetal flow, and an outlet section communicating with the central inlet of the succeeding impeller.

2. The pump according to claim 1 wherein the angle of inclination of the curvature of said pressure and suction faces at the inlet end of said vanes is within the range of 5° to 30° and the angle of inclination of curvature with respect to the suction face at the outlet of said vane is within 100° to 130° and the angle of curvature with respect to the discharge pressure face of the outlet angle is between 60° to 90°.

3. A pump according to claim 1 including a second elbow interposed between said straight section and the inlet of the succeeding impeller said elbow being shaped to direct the flow substantially parallel to the intake surface of said succeeding blade.

* * * * *